United States Patent [19]

Horvath et al.

[11] Patent Number: 4,461,485

[45] Date of Patent: Jul. 24, 1984

[54] METHOD AND APPARATUS FOR A GAME

[76] Inventors: Ronald F. Horvath, 1670 Echo La., Racine, Wis. 53406; John R. Reid, 2431 Blaine Ave., Racine, Wis. 53405; Thad F. Elsmo, 208 East Four Mile Rd., Racine, Wis. 53402

[21] Appl. No.: 345,563

[22] Filed: Feb. 4, 1982

[51] Int. Cl.[3] ..... A63B 65/08; A63B 65/10

[52] U.S. Cl. ..... 273/425; 273/398; 273/426

[58] Field of Search ..... 273/424–426, 273/398, 411, 126 R, 1 A, 400

[56] References Cited

U.S. PATENT DOCUMENTS

| | | | |
|---|---|---|---|
| 638,220 | 12/1899 | De Wolf | 273/398 |
| 819,132 | 5/1906 | Evans | 273/126 R |
| 1,682,279 | 8/1928 | Hilpert | 273/126 R |
| 2,017,536 | 10/1935 | Hase et al. | 273/1 A |
| 3,580,580 | 5/1971 | Wark | 273/425 |
| 3,765,122 | 10/1973 | English | 273/425 X |
| 3,768,809 | 10/1973 | Ciarfello | 273/425 X |
| 3,828,466 | 8/1974 | Geiger | 273/425 X |
| 4,112,612 | 9/1978 | Woods | 273/425 X |
| 4,203,249 | 5/1980 | Böhm | 273/426 X |
| 4,246,720 | 1/1981 | Stone | 273/424 X |
| 4,293,132 | 10/1981 | Starr | 273/1 A X |
| 4,337,950 | 7/1982 | Gidge | 273/426 |

FOREIGN PATENT DOCUMENTS

| | | | |
|---|---|---|---|
| 1196552 | 7/1965 | Fed. Rep. of Germany | 273/424 |
| 599727 | 3/1948 | United Kingdom | 273/411 |

OTHER PUBLICATIONS

General Sportcraft Co. Ltd., Sportcraft Sports Games, How to Throw a Boomerang, 2–1980.

*Primary Examiner*—Paul E. Shapiro

*Attorney, Agent, or Firm*—Andrus, Sceales, Starke & Sawall

[57] ABSTRACT

A flying toy includes an aerodynamic disc having a centrally located opening extending therethrough. A plurality of wings are mounted on the disc adjacent the opening and the wings extend upwardly and outwardly from the opening to a point beyond the periphery of the disc. Each of the wings has a straight edge portion and a flat portion extending downwardly from the edge portion toward the disc. The wings are mounted on the disc in such a manner that the disc may be launched with an imparted rotational motion resulting in the straight edge portions being the leading edge of the wing and the flat portions being the trailing edge of the wings so that horizontal launching of the disc with an imparted rotation causes the disc to rise, hover and return to the launching point.

4 Claims, 9 Drawing Figures

6
16
26
46
40
27
28
34
43
29
31
32
37
38
33
44
6

42
41

36

39

METHOD AND APPARATUS FOR A GAME

This invention relates to a method and apparatus for a game, and, more particularly, it relates to a game which is played out of doors, and which includes a missile thrown at target areas on the ground.

BACKGROUND OF THE INVENTION

The game and the apparatus for playing the game involve the use of an aerodynamic disc, commonly known as a Frisbee, which is popular and in common use today. The so-called Frisbee generally consists of a dish-like disc which is thrown on a horizontal plane into the air and, due to its construction, it sails or floats in the air and ultimately lands on the ground if permitted to do so. These aerodynamic discs sail in the air in the direction in which they are thrown and they fall to the ground at the limit of the extent to which they are thrown. However, in the present invention, the aerodynamic disc utilized in this game is arranged so that it has a boomerang effect, that is, it is thrown away from the user or the one who launches it, and it will hover and then return to at least the proximity of the location from which it was thrown or launched.

With the disc having the boomerang effect as mentioned, it can be utilized in playing a game where the disc is thrown into the air and is permitted to return to a target area on the ground where various target sections are marked with different numerical values, and thus a final score can be tallied for each player who alternately throws the disc. Further, the aerodynamic disc of this invention is provided with a central opening extending through the disc and with wings connected to the disc adjacent the opening, all so that the boomerang effect is achieved.

In summary, the present invention provides a method and apparatus for playing a game where a disc can be thrown into the air and it can land on a target area on the ground so that the player's score can be noted and tallied.

DETAILED DESCRIPTION OF THE METHOD AND APPARATUS

Figure 1:
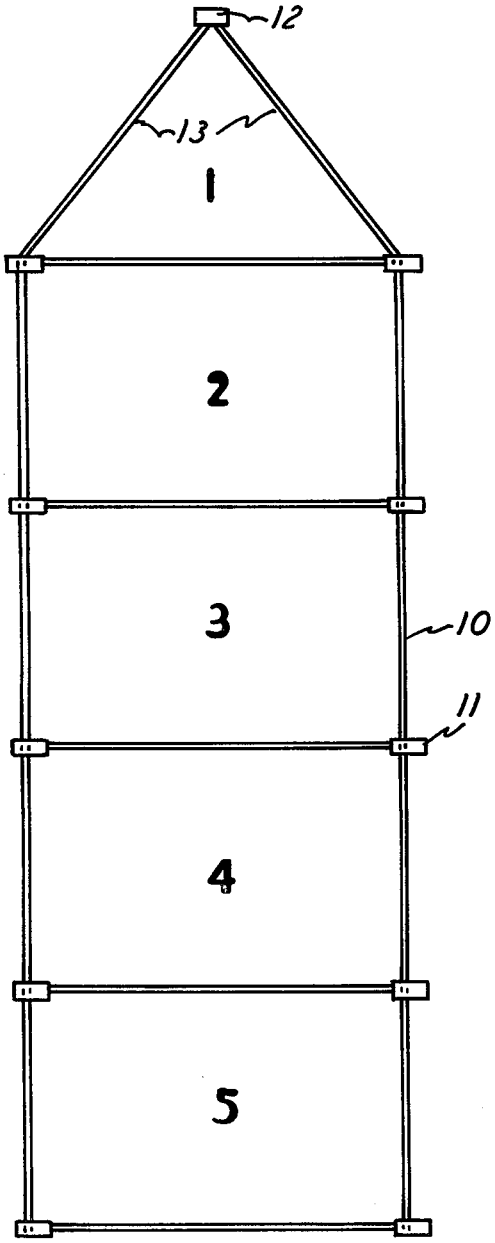
FIG. 1 is a plan view of the target area of this invention.
Figure 1:
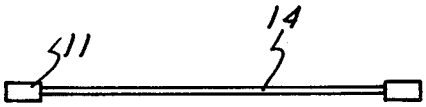

FIG. 1 shows the target area, and, in this instance, it is shown to include the five sections marked 1 through 5, with Section 1 being triangularly shaped and beamed toward what is called the front of the total target area. The rope 10 extends around each of the five target areas mentioned, and stakes 11 can be anchored or pushed into the ground for holding the rope 10 in the position shown in FIG. 1. Thus, stake 11 at the front of the target area defines the point designated 12, and the side ropes

13 constitute an arrowhead shape which points in a direction which may be against the direction of the wind, and thus the target areas 1 through 5 are laid out relative to the direction of the wind and against that direction, as mentioned.

Thus, the stakes 11 hold the rope 10 down onto the surface of the ground to define the plurality of target areas, such as the configuration of the areas shown and described. Further, a rope or other marking 14 is shown adjacent the target areas and serve as a foul line, and the rope 14 can be suitably held on the ground, such as by additional stakes 11.

Figure 2:
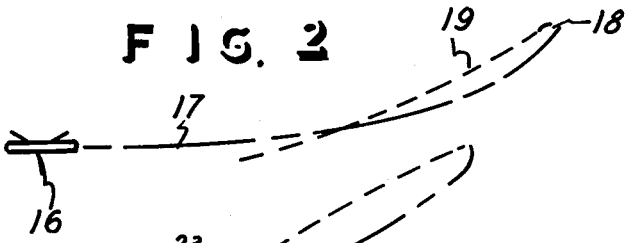
FIGS. 2, 3, and 4 diagrammatically represent the path of flight of the areodynamic disc utilized in this invention.
Figure 3:
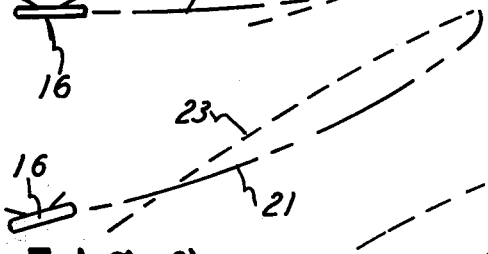
Figure 4:
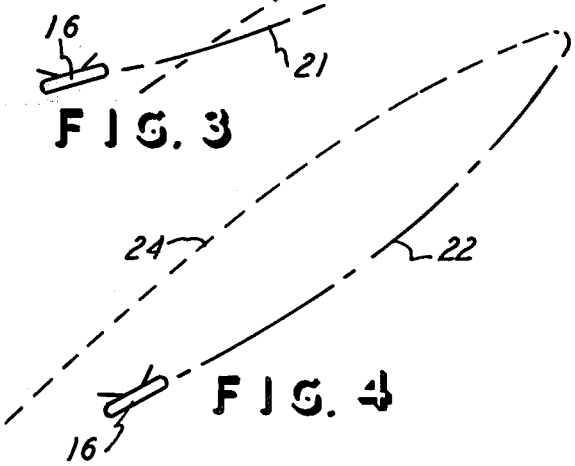

Thus, speaking generally, the player would stand behind the foul line 14, that is, in generally the position of the designation "FIG. 1", and would launch the aerodynamic missile 16, as shown in FIGS. 2, 3, and 4 over the target areas and into the wind, that is, toward the point 12. With the specially arranged missile 16 of this invention, the missile will be thrown over the target areas and therebeyond and will hover and then automatically return to the target areas and may actually land in any one of the five target areas designated. If and when the missile lands in any one of the target areas, the player gets that numerical value, such as 1 through 5 in the arrangement as described herein. Other players will launch the missile 16 in a like manner, and the total scores can be tallied, and the highest score can be the winning score. At this time it will also be mentioned that the missile 16 is of a special configuration, and, since it is launched relative to the direction of the wind, and preferably into the wind, as mentioned in connection with FIG. 1, the missile 16 will have the return or boomerang effect and will come back to land into the target areas, if the player is sufficiently skillful.

FIG. 2 shows the launch of the missile 16 in a horizontal path, and the dot-dash line extending from the missile 16 and designated 17 shows that horizontal launch from which the missile will rise or climb, and it will hover at the location designated 18 and it will then follow the dotted line path designated 19 and return toward the point of launch, namely, where the missile 16 is shown in FIG. 2. Alternatively, the missile can be launched at some inclined angle, such as shown in FIGS. 3 and 4, and the launch patterns there are designated by the dot-dash lines 21 in FIG. 3 and 22 in FIG. 4, with FIG. 4 being a steeper launch direction. Likewise, the return flight of the missile is shown by the dotted lines 23 in FIG. 3 and 24 in FIG. 4. In the instances of FIGS. 2, 3, and 4, it can be seen that the particular direction of the launch, in the manner mentioned in those three instances, will determine the location where the missile 16 will fall, and that location will of course be relative to the several target areas 1 through 5.

Figures 5, 6, 7, 8:
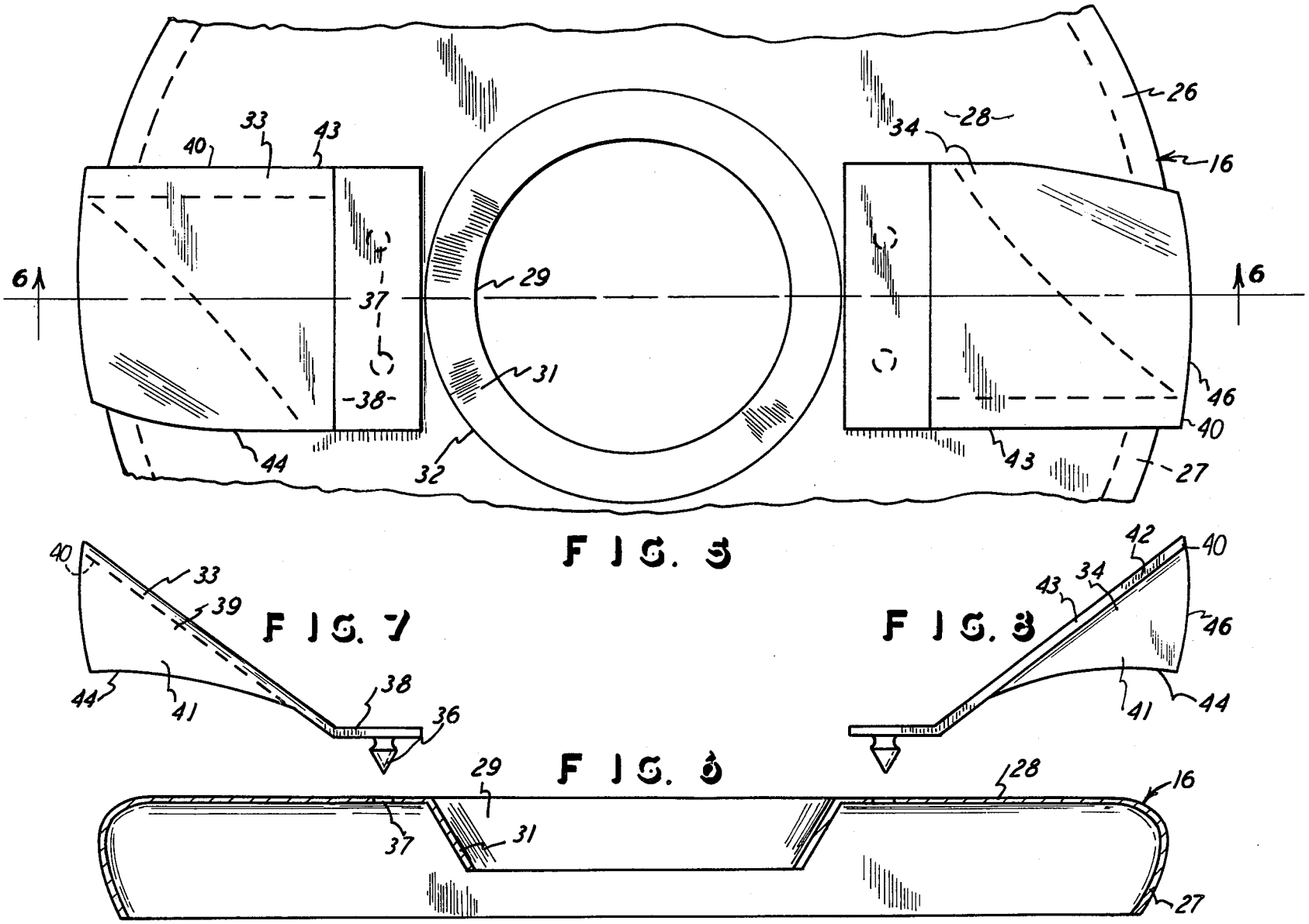
FIG. 5 is a top-plan view of a fragment of the aerodynamic disc of this invention.
FIG. 6 is a sectional view taken on the line 6—6 of FIG. 5.
FIGS. 7 and 8 are side elevational views of the wings attached to the disc of FIG. 6.

FIGS. 5 through 8 show the construction of the aerodynamic missile 16, and it includes the flat disc portion 26, which has the underturned circular flange 27 extending around the circumference or outer edge of the disc top planed designated 28. Also, the disc 26 has a central opening 29, which is defined by the underturned circular flange 31, and the flanges 27 and 31 extend to the same side of the disc top plane 28, as best seen in FIG. 6. Further, the opening 29 is of a circular configuration having a diameter approximately one-third of the diameter of the circular disc 26, as measured relative to the circular line 32 defining the opening 29. Of course the opening 29 is therefore central on the disc 26 and extends completely therethrough, and the flange 31 extends for a distance approximately one-half of the height of the disc as defined by the outer flange 27, all as seen in FIG. 6.

FIGS. 7 and 8 show two wings 33 and 34, which are attached to the disc and extend above the flat surface 28 when the wings 33 and 34 are mounted on the surface 28 by having the arrow-shaped projections 36 extend into the two openings 37 in the disc surface 28 on each side of the opening 29. Of course the projections 36 are slightly flexible, and they may be made of a deformable plastic or the like which permits them to be forced into the two openings 37 for placing the wing base or planar portions 38 parallel and in contact with the disc surface 28. Further, the wings 33 and 34 have upstanding angled portions 39, which are spaced from the surface 28 and which have a substantially straight edge portion 40 and aerodynamic or flap portions 41 depending from edge portion 40 and made of a thin sheet having a thickness designated 42 in FIG. 8. Thus, the two wings 33 and 34 are of identical configuration but are mounted on opposite sides of the disc 26 and they present the flap portions 41 spaced above the disc flat portion 28, all for providing the flight patterns as shown in FIGS. 2, 3, and 4, namely, the hover and dotted line return patterns 19, 23, and 24, respectively.

Thus, the wings 33 and 34 can be boxed and shipped without projecting in their normal position from the disc proper 26, and they can be readily snapped into place through the snaps 36 and holes 37, as shown and described. Further, the wings 33 and 34 have the leading edges 43 and the trailing edges 44, relative to the direction of normal launching of the missile 16, namely, a turning clockwise rotation as viewed from above, and the normal manner in which the person launches or throws a disc or Frisbee, so-called. Further, the radially outer edges 46 of the wings 33 and 34 extend beyond the plane of the outer flange 27 of the disc 26, the thus the wings extend from the opening 29 to a point beyond the plane of the outer circumference of the disc 26 in the manner shown in FIG. 5.

Figure 9:
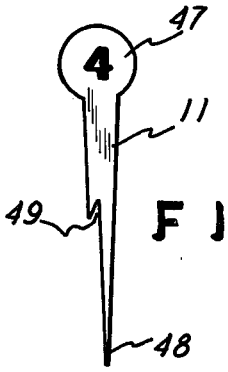
FIG. 9 is a front elevational view of a stake utilized in the target of this invention.

FIG. 9 shows the stake 11 has a head portion 47 on which the numerical value of that stake can be marked, such as the number 4 on the stake shown in FIG. 9, and that particular stake would mark the target area number 4. The stake also has a pointed end 48 which can be pressed into the ground, and it has a notch 49 which will engage the rope 10 and hold the rope on the ground. With that arrangement, the rope 10 and holding and marking stakes 11 can be readily assembled and positioned on the ground.

In summary, the idea is to provide a game where a boomerang type of disc missile is utilized for launching and landing on a target area marked on the ground for a numerical evaluation of the player's skill in hitting the target areas. The particular aerodynamic missile utilized in this invention is deemed to have novelty in that it has the central opening 31 and the plurality of wings 33 and 34, all of which create the return flight of the missile, in the manners designated in FIGS. 2, 3 and 4. In the launch of the missile, the air flow will be through the opening 29 and into the path of the wings 33 and 34 to create the flight patterns described. That is, the launch is generally in the direction against the wind, and the missile 16 will tip up at its forward moving portion and permit the wind to come up through the opening 29, where it engages the wings 33 and 34 and thereby causes the return flight along the dotted lines mentioned. Of course in all instances of launching or throwing, the player is required to throw the missile 16 beyond the point 12, and the return or boomerang effect is then significant.

What is claimed is:

1. A flying toy comprising an aerodynamic disc having a centrally located opening extending therethrough, a plurality of wings mounted on said disc adjacent said opening said wings extending upwardly and outwardly from said opening to a point beyond the periphery of said disc, each of said wings having an edge portion and a flap portion extending downwardly from said edge portion toward said disc, said wings being mounted on said disc in such a manner that said disc may be launched with an imparted rotational motion resulting in said edge portions being the leading edge of said wings and said flap portions being the trailing edge of said wings whereby a horizontal launching of said disc with an imparted rotation causes said disc to rise, hover and return to the launching point.

2. The flying toy of claim 1 wherein said edge portion is substantially straight.

3. The flying toy of claim 1 wherein said opening has a diameter approximately one-third of the diameter of said disc.

4. A flying toy comprising an aerodynamic disc having a flat disc portion and a downwardly depending flange portion, said disc having a centrally located opening extending therethrough a plurality of wings mounted on said flat disc portion, said wings extending outwardly and upwardly from said opening to a point beyond the periphery of said disc, each of said wings having a straight edge portion and a flap portion extending downwardly from said edge portion toward said disc, said wings being mounted on said disc in such a manner that said disc may be launched with an imparted rotational motion resulting in said straight edge portions being the leading edge of said wings and said flap portions being the trailing edge of said wings whereby a horizontal launching of said disc with an imparted rotation causes said disc to rise, hover and return to the launching point.

* * * * *